US005398429A

United States Patent [19]

Olsen

[11] Patent Number: 5,398,429

[45] Date of Patent: Mar. 21, 1995

[54] CLEAT RECEIVING SOLE APPARATUS

[76] Inventor: James A. Olsen, 8157 Darby Ave., Reseda, Calif. 91335

[21] Appl. No.: 287,485

[22] Filed: Aug. 8, 1994

Related U.S. Application Data

[63] Continuation of Ser. No. 89,473, Jul. 12, 1993, abandoned.

[51] Int. Cl.[6] ..... A43B 5/00

[52] U.S. Cl. ..... 36/135; 36/127

[58] Field of Search ..... 36/135, 15, 19.5, 7.5, 36/7.1 R, 19.5, 12, 127, 132, 134, 24

[56] References Cited

U.S. PATENT DOCUMENTS

| | | | |
|---|---|---|---|
| 3,243,902 | 4/1966 | Chapman | 36/135 |
| 3,693,269 | 9/1972 | Guarrera | 36/19.5 |
| 3,913,243 | 10/1975 | Arnold et al. | 36/135 |

FOREIGN PATENT DOCUMENTS

| | | | |
|---|---|---|---|
| 2140273 | 11/1984 | United Kingdom | 36/135 |

*Primary Examiner*—Paul T. Sewell
*Assistant Examiner*—Thomas P. Hilliard

[57] ABSTRACT

A new and improved cleat receiving shoe sole apparatus includes a flexible base member which includes a plurality of wells for receiving respective cleats of a cleated shoe, and which includes a shoe-bonding assembly for bonding the flexible base member to the cleated shoe. The shoe-bonding assembly may include a cleat-bonding assembly, located in the wells, for removably and replaceably bonding the wells to the respective cleats. The shoe-bonding assembly may include a layer of a tacky adhesive applied to a top surface of the flexible base member for adhering the flexible base member to the cleated shoe. Also, the cleat-bonding assembly may include respective layers of a tacky adhesive applied to respective inner walls of the wells, such that the flexible base member may be adhered to the cleats of the shoe. The cleat-bonding assembly may include a plurality of resilient wire bristles which project radially inward from respective inner walls of the wells, such that the flexible base member may be adhered to the cleated shoe by removable and replaceable bonding forces exerted by the resilient wire bristles in the respective wells on the respective cleats. The wells may be conically shaped, such that the cleats are wedged into the wells when the flexible base member may be attached to the cleated shoe.

10 Claims, 4 Drawing Sheets

CLEAT RECEIVING SOLE APPARATUS

This application is a continuation of application Ser. No. 08/089,473, filed Jul. 12, 1993, now abandoned.

BACKGROUND OF THE INVENTION

1. Field of the Invention

The present invention relates generally to soles of shoes, and more particularly, to a shoe soles that are placed over cleated soles to permit the cleated shoes to be used on hard surfaces without damaging the hard surfaces.

2. Description of the Prior Art

Soles that are added on to cleated shoes so that the cleated shoes can be worn on hard surfaces are well known in the art as represented by the following U.S. Pat. Nos. 3,883,963; 3,913,243; 4,807,372; 4,872,273; and 5,070,631. More specifically, U.S. Pat. No. 3,883,963 discloses a cleat guard for installation on the bottom of a sports shoe. The inner walls of cleat-receiving wells are straight and perpendicular to the top surface of the device. As such, the only forces which adhere the cleat guard to the bottom of the athletic shoe are frictional forces between the side walls of the cleat-receiving wells and the cleats. This type of adherence may be unreliable, especially in wet weather when frictional forces would be dramatically reduced. In this respect, it would be desirable if a cleat receiving shoe sole device were provided that did not depend entirely upon frictional forces between wells in the cleat receiving shoe sole device and the cleats for securing the device to the shoe.

U.S. Pat. No. 3,913,243 discloses a golf sandal that is strapped onto a golf shoe to provide an additional undersole to the golf shoe. A plurality of straps are required to secure the protective sole to the shoe. It appears that if the straps are not applied correctly or if they break, then the protective sole will separate from the golf shoe. In this respect, it would be desirable if a cleat receiving shoe sole device were provided which did not depend solely upon straps for adhering the protective sole to the shoe.

U.S. Pat. No. 4,807,372 discloses another walking sole for a cleated shoe. With this device, the walking sole is hinged so as to be especially adaptable for bicycle riding. Repetitive flexing of the hinge disclosed in the material comprising the sole can cause rapid fatigue of the material and breaking of the material. In this respect, it would be desirable if a cleat receiving shoe sole device were provided which did not include a repetitively flexing hinge that causes weakening and destruction of the sole.

U.S. Pat. No. 4,872,273 disclose an add on sole for a spiked shoe in which wide spaces are provided between the spikes and the add on sole. The add on sole is attached to the shoe by using shell-like structures at the front and rear of the sole. Such shell-like structures would be difficult and expensive to make. Furthermore, the inherent capabilities of the cleats for attaching the add on sole to the shoe are completely ignored. In this respect, it would be desirable if a cleat receiving shoe sole device were provided which avoided using shell-like structures for connecting the add on sole to the shoe and which took advantage of the capabilities of the cleats for adhering the add on sole to the shoe.

U.S. Pat. No. 5,070,631 discloses an add on sole for a golf shoe that employs a plurality of separate and distinct sliding clamping member present in the add on sole that clamp onto the cleats of the golf shoe. In practice, it would be very difficult and expensive to equip an add on sole with numerous sliding clamping members to clamp the cleats. In this respect, it would be desirable if a cleat receiving shoe sole device were provided which utilized cleats for attaching the add on sole to the cleated shoe without employing a plurality of numerous sliding clamping members.

Most shoes, whether cleated or not, contain an arched area in the undersole, whereby an empty space is present between a surface being walked on the inner wall of a heel. It is noted that none of the add on soles disclosed in the prior art discussed above employ this empty space and employ the inner wall of the heel for stabilizing the attachment of the add on sole to the cleated shoe. In this respect, it would be desirable if a cleat receiving shoe sole device were provided which utilized the inner wall of the heel for stabilizing the attachment of the add on sole to the cleated shoe.

It is also noted that none of the add on soles disclosed in the prior art discussed above employ features of the top surface of the add on sole for attaching the add on sole to the cleated shoe. Instead, the prior art discloses that the add on soles are secured to the cleated shoes by either straps or means for gripping the cleats. In this respect, it would be deskable if a cleat receiving shoe sole device were provided that employed the top surface of the add on sole for securing the add on sole to the cleated shoe.

It is also noted that none of the add on soles disclosed in the prior art discussed above have means for cleaning the cleats as they are connected to the add on sole. In this respect, it would be desirable if a cleat receiving shoe sole device were provided which cleaned the cleats as the add on sole is worn on the cleated shoe.

Thus, while the foregoing body of prior art indicates it to be well known to use cleat receiving shoe sole devices, the prior art described above does not teach or suggest a cleat receiving shoe sole apparatus which has the following combination of desirable features: (1) does not depend entirely upon frictional forces between wells in the cleat receiving shoe sole device and the cleats for securing the device to the shoe; (2) does not depend solely upon straps for adhering the protective sole to the cleated shoe; (3) does not include a repetitively flexing hinge that causes weakening and destruction of the add on sole; (4) avoids using shell-like structures for connecting the add on sole to the shoe; (5) utilizes cleats for attaching the add on sole to the cleated shoe without employing a plurality of numerous sliding clamping members; (6) utilizes the inner wall of the heel for stabilizing the attachment of the add on sole to the cleated shoe; (7) employs the top surface of the add on sole for securing the add on sole to the cleated shoe; (8) cleans the cleats as the add on sole is worn on the cleated shoe; and (9) takes advantage of the capabilities of the cleats for adhering the add on sole to the shoe. The foregoing desired characteristics are provided by the unique cleat receiving shoe sole apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved cleat receiving shoe sole apparatus which includes a flexible base member which includes a plurality of wells for receiving respective cleats of a cleated shoe, and which includes a shoe-bonding assembly for bonding the flexible base member to the cleated shoe.

The shoe-bonding assembly may include-a cleat-bonding assembly, located in the wells, for removably and replaceably bonding the wells to the respective cleats, such that the flexible base member may be adhered to the cleated shoe by the removable and replaceable bonding between the respective cleat-bonding assembly and the respective cleats.

The shoe-bonding assembly may include a layer of a tacky adhesive applied to a top surface of the flexible base member, such that the flexible base member may be adhered to the cleated shoe by removable and replaceable tacky adhesive bonding between the respective to tacky adhesive layer and a bottom surface of the cleated shoe.

Also, the cleat-bonding assembly may include respective layers of a tacky adhesive applied to respective inner walls of the wells, such that the flexible base member may be adhered to the cleated shoe by removable and replaceable tacky adhesive bonding between the respective tacky adhesive layers and the respective cleats.

The cleat-bonding assembly may include a plurality of resilient wire bristles which project radially inward from respective inner walls of the wells, such that the flexible base member may be adhered to the cleated shoe by removable and replaceable bonding forces exerted by the resilient wire bristles in the respective wells on the respective cleats.

The wells may be conically shaped, such that the cleats are wedged into the wells when the flexible base member may be attached to the cleated shoe.

The flexible base member includes an undersole portion located under a sole portion of the cleated shoe. The flexible base member may include an underheel portion located under a heel portion of the cleated shoe. The undersole portion may include an upper wall portion, adjacent to the underheel portion, for abutting up against an inner side surface of a heel portion of the cleated shoe.

A heel strap may be attached to the underheel portion fit around a rear portion of the cleated shoe. A toe strap may be attached to the undersole portion and fit around a front portion of the cleated shoe. The heel strap and the toe strap are made from elastic material, or each may comprise first and second strap members having fastener means such as mating VELCRO patch elements.

The respective wells include respective inner walls that extend from a top surface of the flexible base member toward a bottom surface of the flexible base member. More specifically, the respective wells may include respective inner walls that extend from a top surface of the flexible base member to respective floor portions spaced a predetermined distance from a bottom surface of the flexible base member. The respective wells include respective tacky adhesive layers on the respective inner walls and the respective floor portions.

Alternatively, the wells may include respective inner walls that extend completely from a top surface of the flexible base member to a bottom surface of the flexible base member. The wells include a plurality of resilient wire bristles which project radially inward from respective inner walls of the wells.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, .and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved cleat receiving shoe sole apparatus which has all of the advantages of the prior art and none of the disadvantages.

It is another object of the present invention to provide a new and improved cleat receiving shoe sole apparatus which may be easily and efficiently manufactured and marketed.

It is a further object of the present invention to provide a new and improved cleat receiving shoe sole apparatus which is of durable and reliable construction.

An even further object of the present invention is to provide a new and improved cleat receiving shoe sole apparatus which is susceptible of a low cost of manufacture with regard to both materials and labor, and which accordingly is then susceptible of low prices of sale to the consuming public, thereby making such cleat receiving shoe sole apparatus available to the buying public.

Still yet a further object of the present invention is to provide a new and improved cleat receiving shoe sole apparatus which does not depend entirely upon frictional forces between wells in the cleat receiving shoe sole device and the cleats for securing the device to the cleated shoe.

Still another object of the present invention is to provide a new and improved cleat receiving shoe sole apparatus that does not depend solely upon straps for adhering the protective sole to the cleated shoe.

Yet another object of the present invention is to provide a new and improved cleat receiving shoe sole apparatus which does not include a repetitively flexing hinge that causes weakening and destruction of the add on sole.

Even another object of the present invention is to provide a new and improved cleat receiving shoe sole apparatus that avoids using shell-like structures for connecting the add on sole to the shoe.

Still a further object of the present invention is to provide a new and improved cleat receiving shoe sole apparatus which utilizes cleats for attaching the add on sole to the cleated shoe without employing a plurality of numerous sliding clamping members.

Yet another object of the present invention is to provide a new and improved cleat receiving shoe sole apparatus that utilizes the inner wall of the heel for stabilizing the attachment of the add on sole to the cleated shoe.

Still another object of the present invention is to provide a new and improved cleat receiving shoe sole apparatus which employs the top surface of the add on sole for securing the add on sole to the cleated shoe.

Yet another object of the present invention is to provide a new and improved cleat receiving shoe sole apparatus cleans the cleats as the add on sole is worn on the cleated shoe.

Still a further object of the present invention is to provide a new and improved cleat receiving shoe sole apparatus that takes advantage of the capabilities of the cleats for adhering the add on sole to the shoe.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
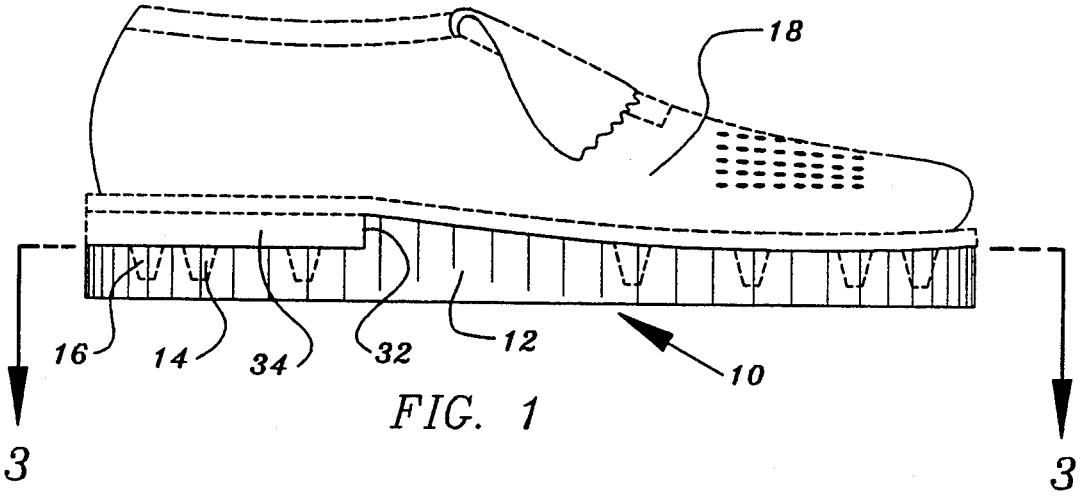
FIG. 1 is a side view showing a first preferred embodiment of the cleat receiving shoe sole apparatus of the invention installed on a cleated shoe.
Figure 2:
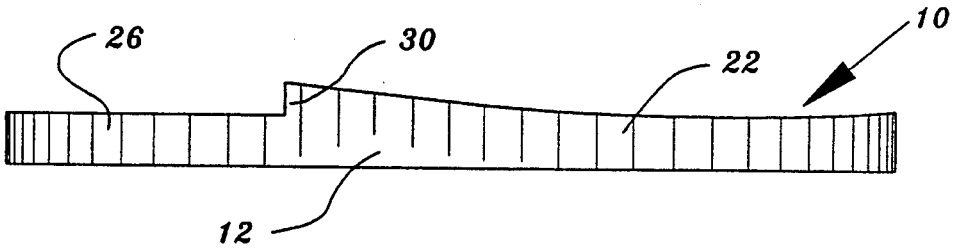
FIG. 2 is a side view of the cleat receiving shoe sole apparatus shown in FIG. 1 separated from the cleated shoe.
Figure 3:
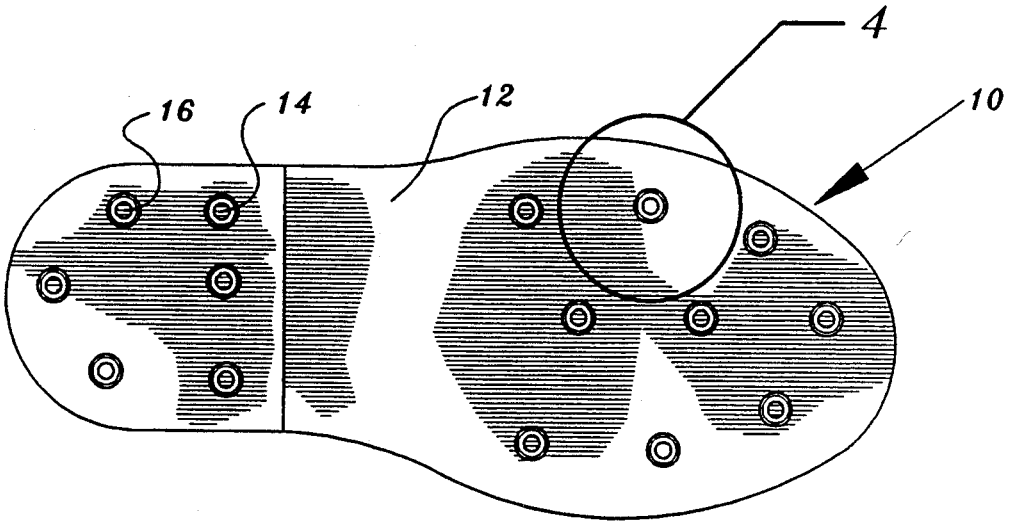
FIG. 3 is a bottom cross-sectional view of the cleat receiving shoe sole apparatus of the invention shown in FIG. 1 installed on a cleated shoe taken along line 3—3 of FIG. 1.
Figure 4:
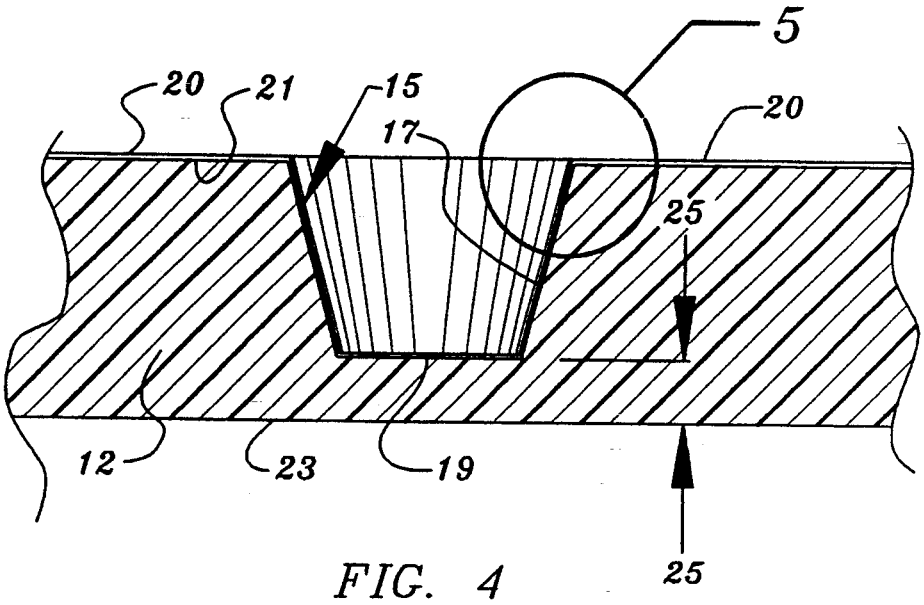
FIG. 4 is an enlarged cross-sectional view taken from the side of the region in circle 4 shown in FIG. 3.
Figure 5:
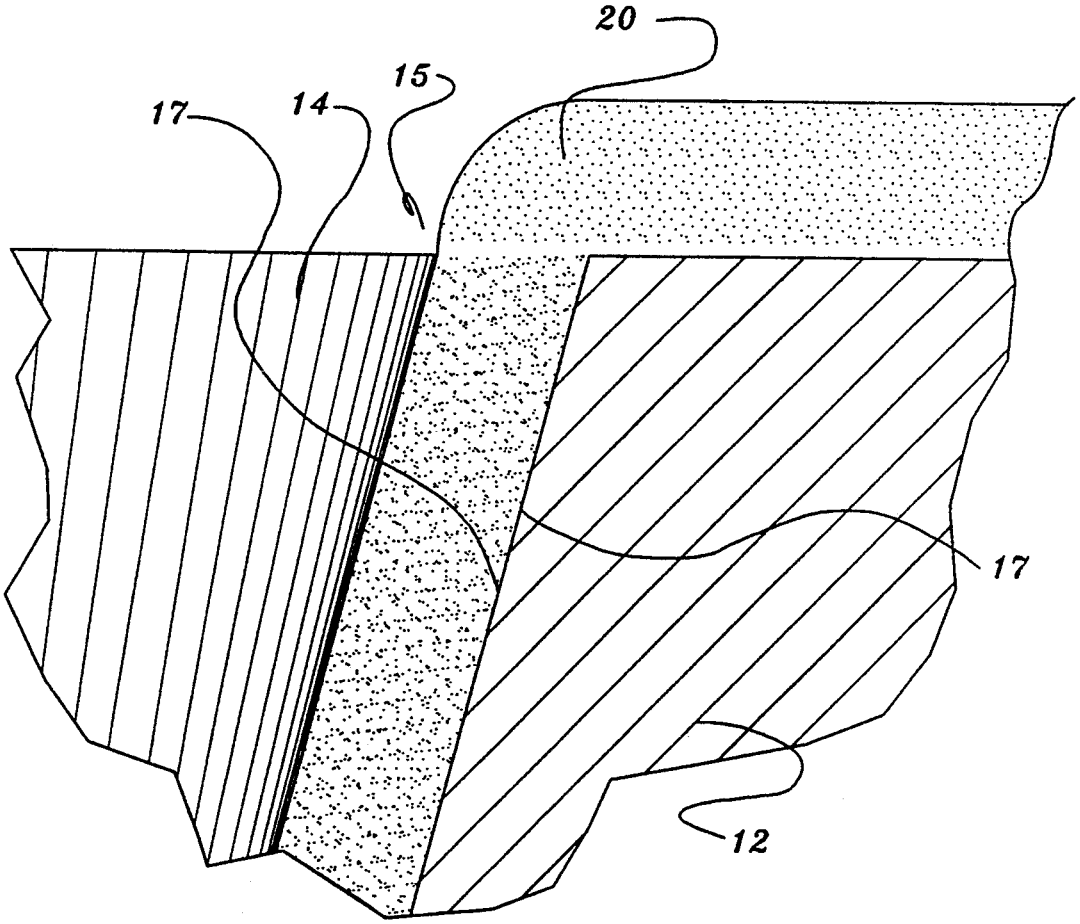
FIG. 5 is an enlarged view of the region in circle 5 shown in FIG. 4.
Figure 6:
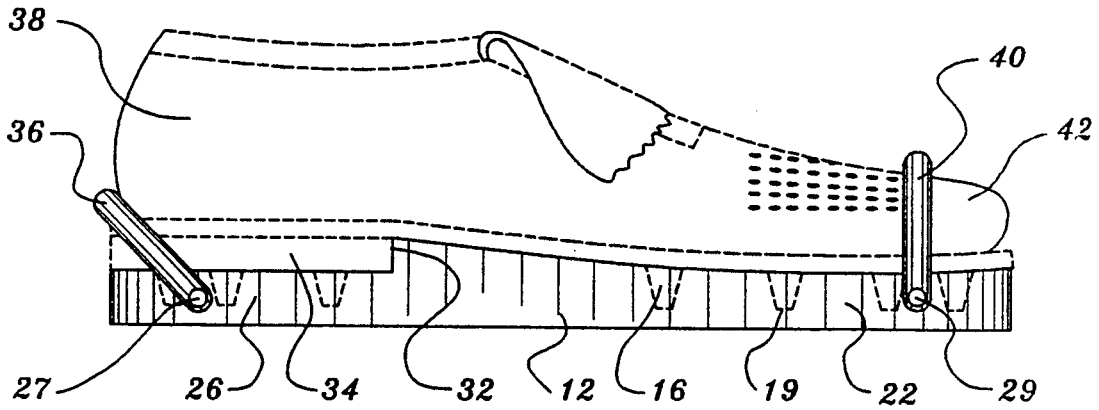
FIG. 6 is a side view showing a second preferred embodiment of the cleat receiving shoe sole apparatus of the invention installed on a cleated shoe which includes straps for helping to secure the cleat receiving shoe sole apparatus to the cleated shoe.
Figure 7:
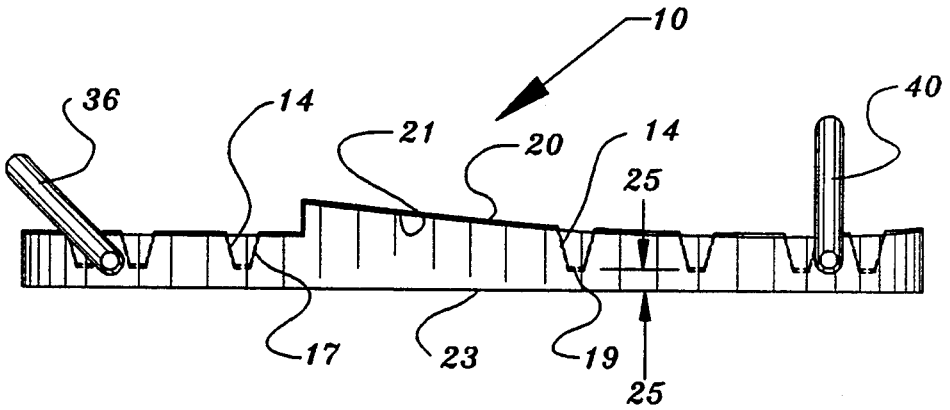
FIG. 7 is a side view of the cleat receiving shoe sole apparatus shown in FIG. 6 separated from the cleated shoe.
Figure 8:
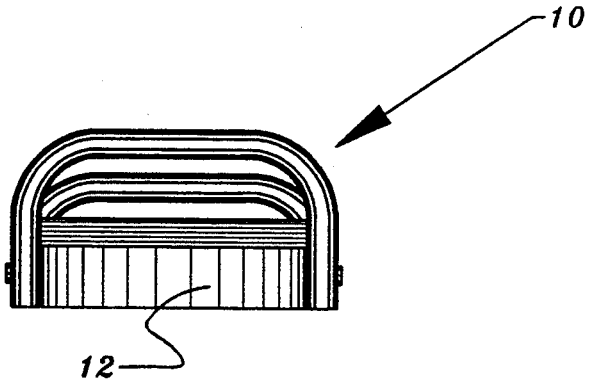
FIG. 8 is a front view of the embodiment of the cleat receiving shoe sole apparatus of the invention shown in FIG. 7.

With reference to the drawings, a new and improved cleat receiving shoe sole apparatus embodying the principles and concepts of the present invention will be described.

Turning initially to FIGS. 1–5, there is shown a first exemplary embodiment of the cleat receiving shoe sole apparatus of the invention generally designated by reference numeral 10. In its preferred form, cleat receiving shoe sole apparatus 10 includes a flexible base member 12 which includes a plurality of wells 14 for receiving respective cleats 16 of a cleated shoe 18, and which includes a shoe-bonding assembly for bonding the flexible base member 12 to the cleated shoe 18. The flexible base member 12 is made from inexpensive resilient flexible materials that are commonly employed in shoe soles, such as plastic, urethane, or synthetic rubber materials. Such materials provide a non-slip contact between the flexible base member 12 and the surface is walked on. The flexible base member 12 not only protects a hard surface, such as a wood floor, from damage by cleats 16. In addition, the flexible base member 12 protects the cleats from damage from hard surfaces, such as concrete or cement sidewalks. The flexible base member 12 has a textured bottom to provide traction and prevent slipping.

The shoe-bonding assembly includes a cleat-bonding assembly 15, located in the wells 14, for removably and replaceably bonding the wells 14 to the respective cleats 16, such that the flexible base member 12 is adhered to the cleated shoe 18 by the removable and replaceable bonding between the respective cleat-bonding assembly 15 and the respective cleats 16.

The shoe-bonding assembly includes a layer 20 of a tacky adhesive applied to a top surface 21 of the flexible base member 12, such that the flexible base member 12 is adhered to the cleated shoe 18 by removable and replaceable tacky adhesive bonding between the respective to tacky adhesive layer 20 and a bottom surface of the cleated shoe 18.

Also, the cleat-bonding assembly 15 includes respective layers 20 of a tacky adhesive applied to respective inner walls 17 of the wells 14, such that the flexible base member 12 is adhered to the cleated shoe 18 by removable and replaceable tacky adhesive bonding between the respective tacky adhesive layers 20 and the respective cleats 16. The tacky adhesive present in the tacky adhesive layer 20 is comprised of well known adhesives that provide a tacky, impermanent bond that can be broken to separate adhered parts and that can be reformed when the separated parts are placed together again. Such tacky adhesives can be used over and over again. Such tacky adhesives are commonly used on removable, postable note papers. In addition, such tacky adhesives are commonly used on pressure-sensitive adhesive tapes. Such tacky adhesives are often composed of urethane adhesives. Some tacky adhesives show greater degrees of adhesion in wet environments, and such adhesives can be readily employed with the cleat receiving shoe sole apparatus of the invention.

As shown in FIGS. 1, 4, 6, and 7, the wells 14 are conically shaped, such that the cleats 16 are wedged into the wells 14 when the flexible base member 12 is attached to the cleated shoe 18.

The flexible base member 12 includes an undersole portion 22 located under a sole portion 24 of the cleated shoe 18. The flexible base member 12 includes an underheel portion 26 located under a heel portion 28 of the cleated shoe 18. The undersole portion 22 includes an upper wall portion 30, adjacent to the underheel portion 26, for abutting up against an inner side surface 32 of a heel portion 34 of the cleated shoe 18.

Turning to FIGS. 6–9, a second embodiment of the invention is shown. Reference numerals are shown that correspond to like reference numerals that designate like elements shown in the other figures. In addition, a heel strap 36, attached to the underheel portion 26, fits around a rear portion 38 of the cleated shoe 18, and a toe strap 40, attached to the undersole portion 22, fits around a front portion 42 of the cleated shoe 18. The heel strap 36 and the toe strap 40 are fitted to the flexible base member 12 by respective hinges 27 and 29. The heel strap 36 and the toe strap 40 provide additional security to keep the flexible base member 12 adhered to the cleated shoe 18. The heel strap 36 and the toe strap 40 are made from elastic material. Alternatively, heel strap 36 and toe strap 40 may each comprise a pair of straps (i.e. first and second straps) fastened to each other as by the use of cooperating VELCRO loop and hook pile fastener elements with the first and second straps being readily adjustable with respect to each other to assure a secure fit of the undersole to the cleated shoe.

The respective wells 14 include respective inner walls 17 that extend from a top surface 21 of the flexible base member 12 toward a bottom surface 23 of the flexible base member 12. More specifically, the respective wells 14 include respective inner walls 17 that extend frown a top surface 21 of the flexible base member 12 to respective floor portions 19 spaced a predetermined distance 25 from a bottom surface 23 of the flexible base member 12. The respective wells 14 include respective tacky adhesive layers 20 on the respective inner walls 17 and the respective floor portions 19.

Figure 9:
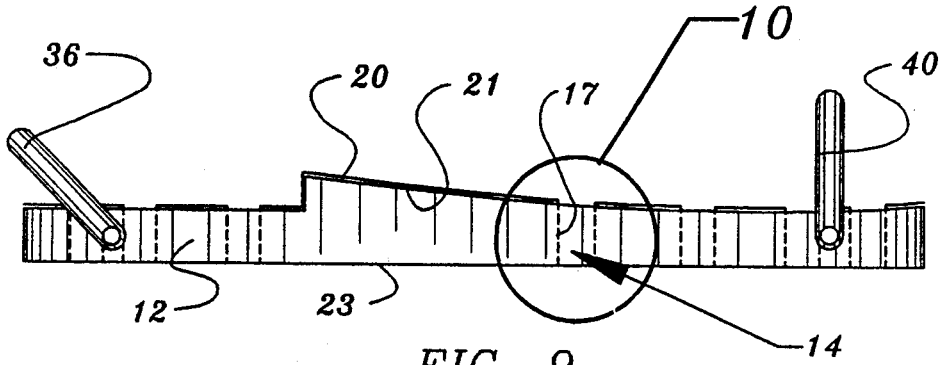
FIG. 9 is a side view of a third preferred embodiment of the cleat receiving shoe sole apparatus of the invention which includes wells that include a plurality of resilient wire bristles that project radially inward from respective inner walls of the wells, wherein the wells include respective inner walls that extend completely from a top surface of the flexible base member to a bottom surface of the flexible base member.
Figure 10:
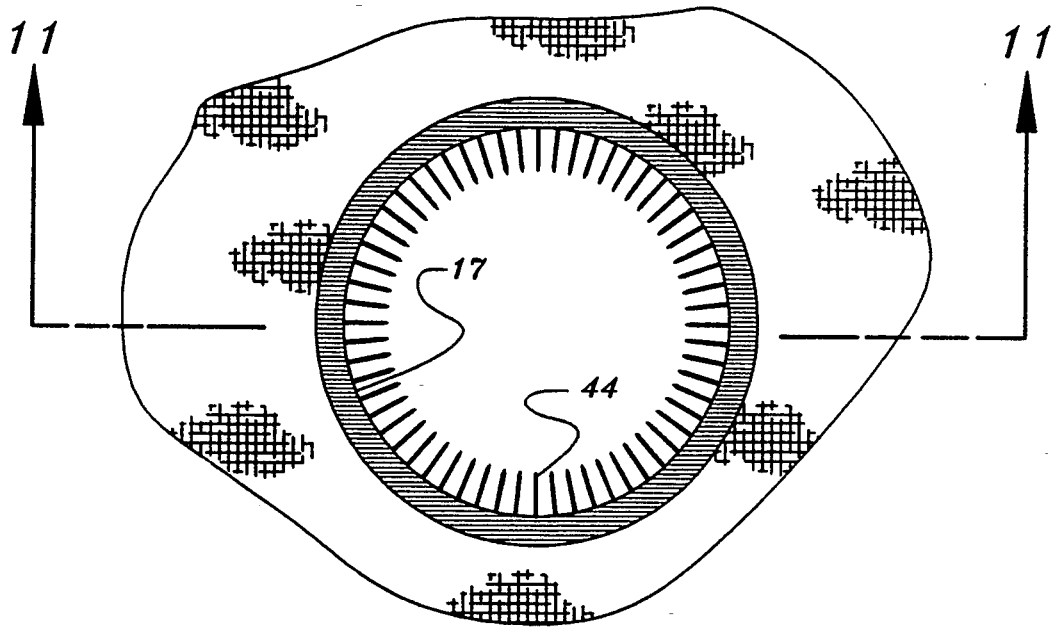
FIG. 10 is a enlarged bottom view of the region in the circle 10 shown in FIG. 9.
Figure 11:
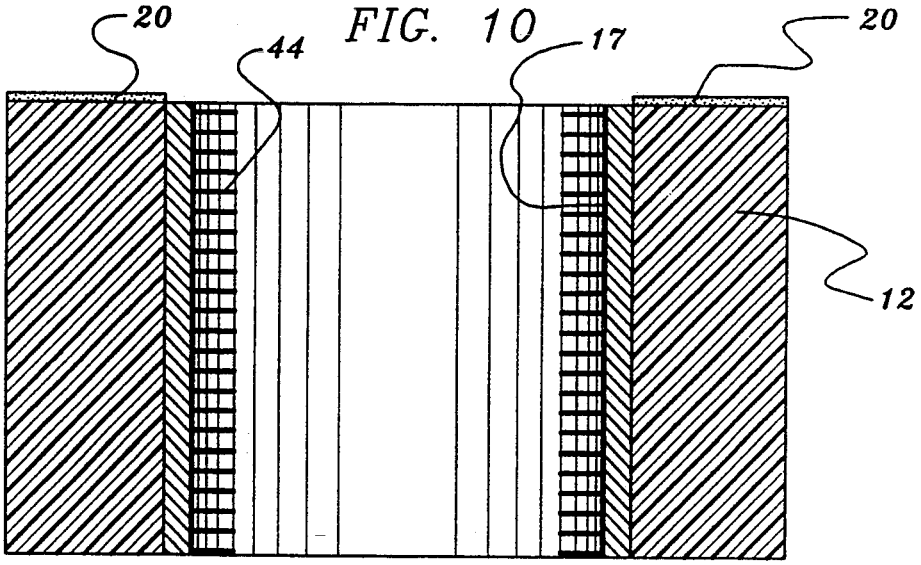
FIG. 11 is a side cross-sectional view of the embodiment of the invention shown in FIG. 10 taken along the line 11—11 of FIG. 10.

Turning to FIGS. 9–11, a third embodiment of the invention is shown. Reference numerals are shown that correspond to like reference numerals that designate like elements shown in the other figures. In addition, the wells 14 include respective inner walls 17 that extend completely from a top surface 21 of the flexible base member 12 to a bottom surface 23 of the flexible base member 12. The wells 14 include a plurality of resilient wire bristles 44 which project radially inward from respective inner walls 17 of the wells 14. The resilient wire bristles 44 serve two distinct functions. They serve to bond the flexible base member 12 to the cleats 16 of the cleated shoe 18. In addition the resilient wire bristles 44 serve to scrape and clean the cleats 16 as the flexible base member 12 is worn on the cleated shoe 18. Material that is scraped off of the cleats 16 can fall away from the flexible base member 12 and the cleated shoe 18 by falling out the bottom opening of the respective wells 17.

The cleat receiving shoe sole apparatus of the invention can be used with golf shoes and with other types of cleated athletic shoes such as football shoes, baseball shoes, and running shoes.

It is apparent from the above that the present invention accomplishes all of the objects set forth by providing a new and improved cleat receiving shoe sole apparatus that is low in cost, relatively simple in design and operation, and which does not depend entirely upon frictional forces between wells in the cleat receiving shoe sole device and the cleats for securing the device to the shoe. With the invention, a cleat receiving shoe sole apparatus is provided which does not depend solely upon straps for adhering the protective sole to the cleated shoe. With the invention, a cleat receiving shoe sole apparatus is provided which does not include a repetitively flexing hinge that causes weakening and destruction of the add on sole. With the invention, a cleat receiving shoe sole apparatus is provided which avoids using shell-like structures for connecting the add on sole to the shoe. With the invention, a cleat receiving shoe sole apparatus is provided which utilizes cleats for attaching the add on sole to the cleated shoe without employing a plurality of numerous sliding clamping members. With the invention, a cleat receiving shoe sole apparatus is provided which utilizes the inner wall of the heel of the cleated shoe for stabilizing the attachment of the add on sole to the cleated shoe. With the invention, a cleat receiving shoe sole apparatus is provided which employs the top surface of the add on sole for securing the add on sole to the cleated shoe. With the invention, a cleat receiving shoe sole apparatus is provided which cleans the cleats as the add on sole is worn on the cleated shoe. With the invention, a cleat receiving shoe sole apparatus is provided which takes advantage of the capabilities of the cleats for adhering the add on sole to the shoe.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved cleat receiving shoe sole apparatus, comprising:

a flexible base member which includes a plurality of wells for receiving respective cleats of a cleated shoe, and which further includes shoe-bonding assembly means for bonding said flexible base member to the cleated shoe, wherein said further shoe-bonding assembly means include cleat-bonding assembly means, located in said wells, for removably and replaceably bonding said wells to the respective cleats, such that said flexible base member is adhered to the cleated shoe by said removable and replaceable bonding between said respective cleat-bonding assembly means and the respective cleats in addition to the frictional engagement between said cleats and said base member when said cleats are received in said wells, wherein said cleat-bonding assembly means include respective layers of a tacky adhesive applied to respective inner walls of said wells, such that said flexible base member is adhered to the cleated shoe by removable and replaceable tacky adhesive bonding between said respective tacky adhesive layers and the respective cleats, and wherein said wells are conically shaped, such that the cleats are wedged into said wells when said flexible base member is attached to the cleated shoe.

2. The apparatus described in claim 1 wherein:

said flexible base member includes an undersole portion located under a sole portion of the cleated shoe, said flexible base member includes an underheel portion located under a heel portion of the cleated shoe, and said undersole portion includes an upper wall portion, adjacent to said underheel portion, for abutting up against an inner side surface of a heel portion of the cleated shoe.

3. The apparatus described in claim 2, further including:

a heel strap, attached to said underheel portion, for fitting around a rear portion of the cleated shoe, and a toe strap, attached to said undersole portion, for fitting around a front portion of the cleated shoe.

4. The apparatus described in claim 3 wherein said heel strap and said toe strap are made from elastic material.

5. The apparatus described in claim 1 wherein said respective wells include respective inner walls that extend from a top surface of said flexible base member toward a bottom surface of said flexible base member.

6. The apparatus described in claim 1 wherein said respective wells include respective inner walls that extend from a top surface of said flexible base member to respective floor portions spaced a predetermined distance from a bottom surface of said flexible base member.

7. The apparatus described in claim 6 wherein said respective wells include respective tacky adhesive layers on said respective inner walls and said respective floor portions.

8. The apparatus described in claim 1 wherein said wells include respective inner walls that extend completely from a top surface of said flexible base member to a bottom surface of said flexible base member.

9. A new and improved cleat receiving shoe sole apparatus, comprising:

a flexible base member which includes a plurality of wells for receiving respective cleats of a cleated shoe, and which includes shoe-bonding assembly means for bonding said flexible base member to the cleated shoe, wherein said shoe-bonding assembly means include cleat-bonding assembly means, located in said wells, for removably and replaceably bonding said wells to the respective cleats, such that said flexible base member is adhered to the cleated shoe by said removable and replaceable bonding between said respective cleat-bonding assembly means and the respective cleats, wherein said cleat-bonding assembly means include a plurality of resilient wire bristles which project radially inward from respective inner walls of said wells, such that said flexible base member is adhered to the cleated shoe by removable and replaceable bonding forces exerted by said resilient wire bristles in said respective wells on the respective cleats.

10. A new and improved cleat receiving shoe sole apparatus, comprising:

a flexible base member which includes a plurality of wells for receiving respective cleats of a cleated shoe, and which includes shoe-bonding assembly means for bonding said flexible base member to the cleated shoe, wherein said wells include respective inner walls that extend completely from a top surface of said flexible base member to a bottom surface of said flexible base member, wherein said wells include a plurality of resilient wire bristles which project radially inward from respective inner walls of said wells.

* * * * *